United States Patent [19]

Palka

[11] 4,058,718

[45] Nov. 15, 1977

[54] SOFFIT LIGHTING

[75] Inventor: James J. Palka, Arlington Heights, Ill.

[73] Assignee: General Bathroom Products Corporation, Elk Grove Village, Ill.

[21] Appl. No.: 713,689

[22] Filed: Aug. 12, 1976

[51] Int. Cl.[2] ..... F21V 33/00; A47B 97/00

[52] U.S. Cl. ..... 362/235; 312/223

[58] Field of Search ..... 240/4.1, 4.2, 6; 312/223, 224, 225

[56] References Cited

U.S. PATENT DOCUMENTS

| | | | |
|---|---|---|---|
| 1,272,524 | 7/1918 | Rabenold et al. | 240/6 |
| 1,911,826 | 5/1933 | Kaelber | 312/223 X |
| 3,067,667 | 12/1962 | Krehbiel | 312/223 X |
| 3,081,397 | 3/1963 | Tantillo et al. | 240/4.1 |
| 3,780,281 | 12/1973 | Ohlhauser et al. | 240/4.1 |

*Primary Examiner*—Donald A. Griffin

*Attorney, Agent, or Firm*—Rummler & Snow

[57] ABSTRACT

A soffit lighting fixture removably secured above and associated with a wall cabinet generally referred to as a medicine cabinet which is fixed above the washbasin with or without the vanity base. The lighting fixture supplies light above and around the foregoing basin.

3 Claims, 8 Drawing Figures

SOFFIT LIGHTING

BACKGROUND OF THE INVENTION

In prior art devices, the lighting fixture is normally an integral part of the medicine cabinet and the fixture was on both sides thereof and thus it was very difficult to keep clean, change lamps, etc. The soffit lighting fixture of the present invention was designed to modernize bathroom lighting.

SUMMARY OF THE INVENTION

A soffit lighting fixture having side and front walls, an electrical housing secured to and between the side walls and spaced away from the front wall, the electrical housing having top and side walls and an L-shaped plate, one leg of the plate forming a bottom wall for the electrical housing and containing a series of electric lamp sockets in the leg, the other leg depending from said aforesaid one leg to form a light deflector, and bracket means to secure the fixture to a wall above the medicine cabinet in the bath or powder room.

DETAILED DESCRIPTION OF THE DRAWINGS

Figure 1:
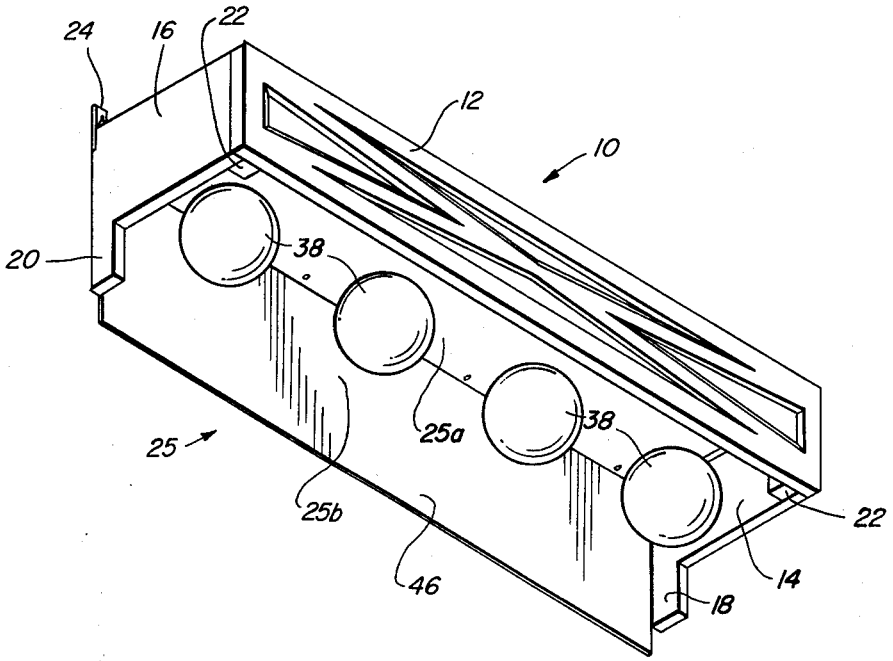
FIG. 1 is a perspective view of the light fixture of the present invention.
Figure 2:
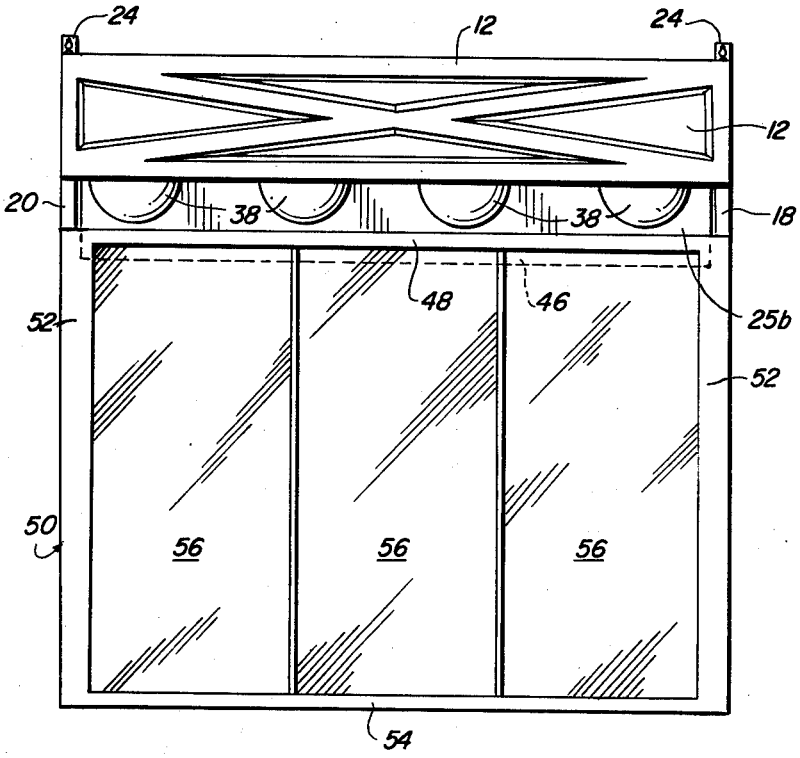
FIG. 2 is a front elevational view of the device of the present invention shown above a medicine cabinet.
Figure 3:
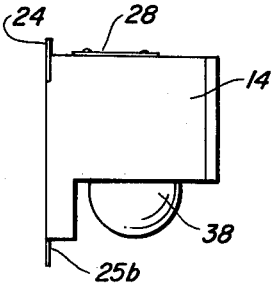
FIG. 3 is an end elevational view of the fixture.
Figure 4:
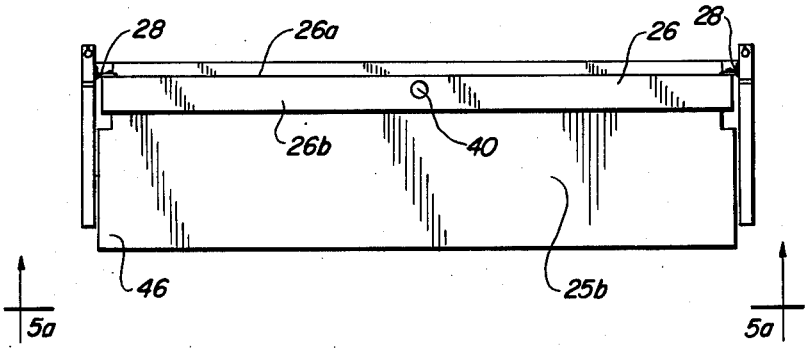
FIG. 4 is a rear elevational view of the fixture.

A lighting fixture of the class described above wherein a U-shaped housing 10 has an ornamental front wall 12 and side walls 14, 16 having depending portions 18, 20. The walls 12, 14 and 16 are held together by cleats 22, 22 which are integrally secured to the respective walls. The rear ends of side walls 14, 16 are provided with bayonet slot hangers 24.

Figure 7:
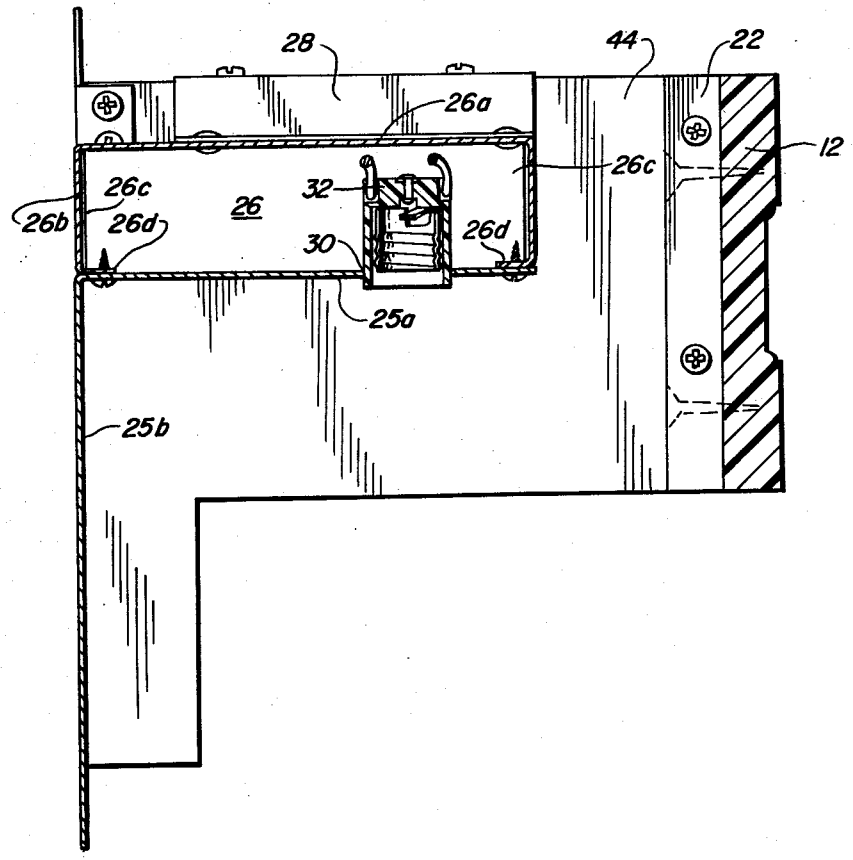
FIG. 7 is a cross-sectional view taken on the lines 7—7 of FIG. 1.

The electrical housing 26 is rectangular in shape having a top, end and side walls **26*a*, 26*b* and 26*c*, respectively, and provided with short, inwardly extending flanges 26*d* on the lower ends of each of said side and end walls. The housing 26 is anchored to the side walls 14, 16 and top wall 26*a* by offset brackets 28, as clearly shown in FIGS. 5A, 6 and 7, whereby the top wall 26*a* of housing 26 is positioned below the top edges of side walls 14, 16 and front wall 12. An L-shaped sheet metal plate 25 has one leg 25*a* which comprises a cover plate which is anchored to the flanges 26*d* of the housing 26 and a second leg 25*b* depending from cover plate 25*a*. The surfaces of plate 25 may be anodized or plated to make it reflective. The leg or cover plate 25*a* is provided with four spaced apertures 30 (see FIGS. 5A, 6 and 7) for the reception of lamp sockets 32 which are each positioned therein by a clamp 34 secured to the top of the lamp socket 32 (see FIG. 6). Each aperture 30 is provided with opposed cutouts 36 for the reception of the end of clamp 34 (see FIG. 6**).

The sockets 32 support an incandescent bulb 38. The four lamp sockets 32 are electrically connected together and appropriately electrically connected to a source of current through knockout 40. The leg or cover plate **25*a* is removably secured to the housing 26 preferably by screws 42**.

Figure 5:
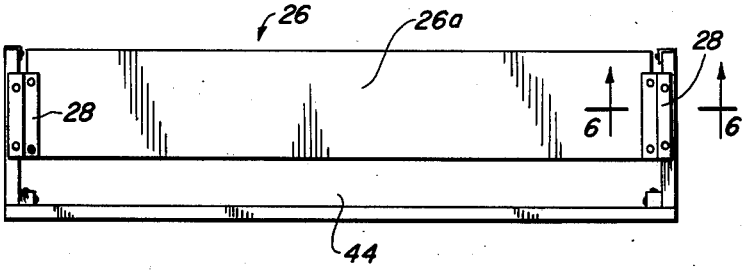
FIG. 5 is a top elevational view thereof.
Figure 5A:
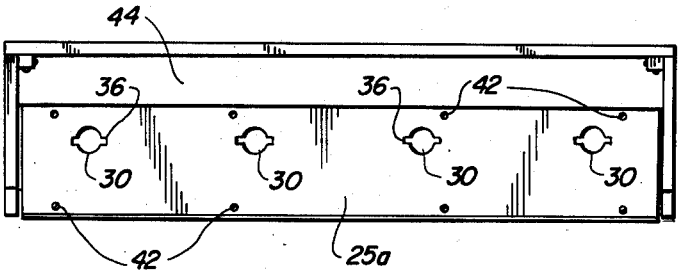
FIG. 5A is a bottom elevational view thereof with lamp sockets removed.
Figure 6:
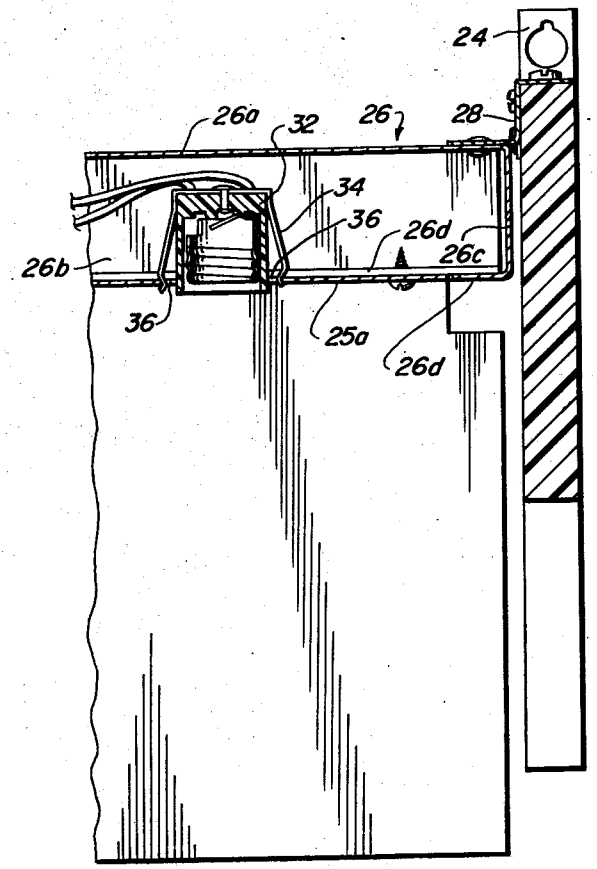
FIG. 6 is a cross-sectional view taken on the lines 6—6 of FIG. 5.

As seen especially in FIGS. 5 and 5A, there is considerable unrestricted area at 44 to allow the air heated from the lamps 38 to escape upwardly into the room area.

To install this lighting fixture, the bottom end 46 of the second leg **25*b* is placed against the top of the cabinet if the same is surface mounted, or behind the facia strip or upper border 48 of the cabinet if installed in a recess in the wall. The depending portions 20, 22 extend along the outside edges of the side frames 50 and top border 48. The usual mirrors 56 are installed within the top, bottom and side frames 48, 54 and 52**, respectively, in the usual manner.

Although but one specific embodiment of this invention is herein shown and described, it will be understood that details of the construction shown may be altered or omitted without departing from the spirit of the invention as defined by the following claims.

I claim:

1. A soffit lighting fixture for cabinets comprising an elongated outer housing having side walls and an ornamental front wall, an elongated electrical housing positioned between and anchored to said side walls interiorally of said outer housing, said electrical housing having side, end and top walls, an L-shaped plate, a first leg of said plate anchored to said electrical housing and forming a cover therefor, said first leg having a plurality of spaced lamp sockets secured thereto and extending downwardly, the second leg of said plate depending from said first leg forming a rear wall for said fixture and extending downwardly below said outer housing side walls, both of said legs having reflective properties, means to secure said fixture to a wall surface, and means for electrically connecting said sockets.

2. The device according to claim 1 wherein each of said side walls of said outer housing has an integrally formed, downwardly extending portion, and said second leg of said plate extends downwardly below said portions.

3. The device according to claim 1 wherein said first leg of said plate being provided with a series of lamp socket perforations, opposed cutouts extending laterally of and in communication with said perforations, a lamp socket for each of said perforations, said lamp socket having a clamp associated therewith and connectable to said first leg in said cutouts.

* * * * *